US008324825B2

(12) United States Patent
Shao et al.

(10) Patent No.: US 8,324,825 B2
(45) Date of Patent: Dec. 4, 2012

(54) METHOD AND CIRCUIT FOR DRIVING A LOW VOLTAGE LIGHT EMITTING DIODE

(75) Inventors: Jianwen Shao, Hoffman Estates, IL (US); Clifford J. Ortmeyer, II, McHenry, IL (US)

(73) Assignee: STMicroelectronics, Inc., Coppell, TX (US)

( * ) Notice: Subject to any disclaimer, the term of this patent is extended or adjusted under 35 U.S.C. 154(b) by 497 days.

(21) Appl. No.: 12/189,411

(22) Filed: Aug. 11, 2008

(65) Prior Publication Data

US 2008/0297069 A1 Dec. 4, 2008

Related U.S. Application Data

(62) Division of application No. 10/930,227, filed on Aug. 31, 2004, now Pat. No. 7,425,803.

(51) Int. Cl.
*G05F 1/00* (2006.01)

(52) U.S. Cl. ..... 315/291; 315/247; 315/185 S; 315/307; 315/224

(58) Field of Classification Search ..... 315/247, 315/224, 225, 185 S, 291, 307–312
See application file for complete search history.

(56) References Cited

U.S. PATENT DOCUMENTS

| | | | | |
|---|---|---|---|---|
| 6,636,003 | B2 * | 10/2003 | Rahm et al. | 315/179 |
| 7,557,519 | B2 * | 7/2009 | Kranz | 315/291 |
| 2002/0011804 | A1 * | 1/2002 | Fujimura et al. | 315/291 |
| 2003/0117088 | A1 * | 6/2003 | Tanabe et al. | 315/291 |
| 2004/0183482 | A1 * | 9/2004 | Roberts et al. | 315/363 |

* cited by examiner

*Primary Examiner* — Tuyet Thi Vo
(74) *Attorney, Agent, or Firm* — Leveque IP Law, P.C.

(57) ABSTRACT

In a method for producing a control signal for regulating a drive current for driving an LED, a current through the LED is sensed, wherein the LED is driven by a power converter output, and wherein an output voltage of the power converter is proportionately controlled by a control signal. Next, a power supply voltage is sensed. The control signal is produced for the power converter, wherein the control signal is proportional to a difference between a reference voltage and the current through the LED. The control signal is then offset in response to the power supply voltage to reduce the current through the LED as the power supply voltage drops.

8 Claims, 3 Drawing Sheets

METHOD AND CIRCUIT FOR DRIVING A LOW VOLTAGE LIGHT EMITTING DIODE

This is a divisional of co-pending application Ser. No. 10/930,227 filed on Aug. 31, 2004, the entire disclosure of which is incorporated into this application by reference and to which the instant application claims priority under the statute.

BACKGROUND OF THE INVENTION

1. Field of the Invention

The present invention relates generally to methods and circuits for driving light emitting diodes, and more specifically to methods and circuits for driving light emitting diodes to extend battery life.

2. Description of the Prior Art

The use of light emitting diodes (LEDs) has become increasingly popular in small, portable, battery-powered electronics. For example, many handheld electronics incorporate color displays that use white LEDs as a backlight. Many of these LEDs require a drive voltage that is higher than the voltage of the battery pack power source. For example, the forward voltage drop of a white LED may be approximately 3.5 volts, which is a voltage higher than a device powered by one or two cells can provide.

In order to provide the high forward-voltage requirement of the LEDs and to regulate the drive current, specialized power converters for regulating or stepping-up voltage have been developed. Such power converters have been designed to minimize LED intensity variations with battery voltage, and to minimize brightness variations between different LEDs, which may be used, for example, to light portions of the same color display.

Most of the specialized power converters fall into one of two commonly used regulator types: inductor-based boost converters and capacitor-based charge pump converters.

The boost converter works cyclically by storing energy in an inductor when a switch is on, and dumping the stored energy together with energy from the input into the load when the switch is off. The output voltage is controlled and regulated by varying the amount of energy stored and dumped each cycle. When the switch is on, the supply voltage is applied across the inductor, and the current through the inductor increases linearly. During the on state, the capacitor supplies the load with energy and, thus, the voltage across the capacitor is reduced. When the switch is turned off, the current continues through the inductor, supplying the load via a diode. Consequently the current decreases linearly.

A charge pump uses two or more capacitors and switches to charge and transfer charge from one capacitor to another, thereby producing an output voltage greater than the input voltage.

In battery powered applications, such power converter circuits are typically designed to maintain a constant current through one or more LEDs to maintain constant LED brightness over the entire range of battery voltages, from full charge to almost fully discharged. While it may be aesthetically pleasing, attempting to maintain full drive current as the battery discharges greatly reduces the duration of battery powered operation, particularly near the end of the battery's charge. Many times the operator of a battery powered device would rather operate with dimmed LEDs for a longer period of time rather than with fully bright LEDs for a shorter period.

Therefore, there is a need for a method and circuit for regulating the current through an LED while taking into account battery voltage and extending the useful battery life.

SUMMARY OF THE INVENTION

The present invention provides a method in a semiconductor device for producing a control signal for regulating a drive current for driving an LED. A current through the LED is sensed, wherein the LED is driven by a power converter output, and wherein an output current of the power converter is proportionately controlled by a control signal. Next, a power supply voltage is sensed. The control signal is produced for the power converter, wherein the control signal is proportional to a difference between a reference voltage and the current through the LED. The control signal is then offset in response to the power supply voltage to reduce the current through the LED as the power supply voltage drops.

The present invention further provides a feedback circuit in an integrated circuit for regulating a drive current for driving an LED. The circuit includes an error amplifier for comparing an LED current feedback voltage and a reference voltage to produce a control signal or a LED current set point signal, wherein the set point signal corresponds to a desired current flow in the LED. A circuit is coupled to the error amplifier for changing or offsetting the LED current set point signal in response to a power supply voltage.

BRIEF DESCRIPTION OF THE DRAWINGS

For a more complete understanding of the present invention, and the advantages thereof, reference is now made to the following descriptions taken in conjunction with the accompanying drawings, in which like numbers designate like parts, and in which.

DESCRIPTION OF THE PREFERRED EMBODIMENTS

Figure 1:
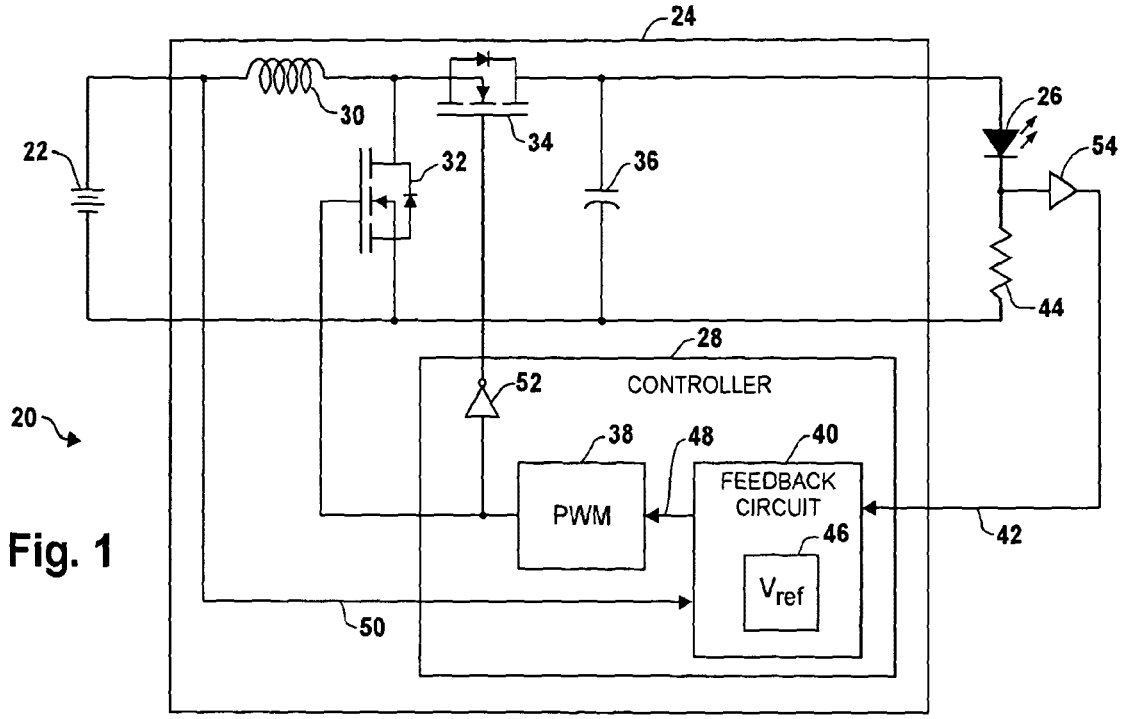
FIG. 1 is a high-level schematic diagram of a drive circuit for driving an LED in accordance with the method and circuit of the present invention.

With reference now to the drawings, and in particular with reference to FIG. 1, there is depicted a high-level schematic diagram of a drive circuit for driving an LED in accordance with the method and circuit of the present invention. As illustrated, LED drive circuit 20 includes power supply or battery 22 coupled to power converter 24 for driving LED 26. Within power converter 24, controller 28 regulates and controls the operation of stepping up voltage for driving LED 26 with a sufficient current so that LED 26 produces a desired level of light output. For example, if LED 26 is implemented with a white LED, the LED may require approximately 3.5 volts across the LED and operate with about 350 milliamps (mA) of current at full brightness for a 1 watt LED. Such a white LED may require a drive voltage that exceeds the voltage of battery 22, particularly when a device is powered by a one- or two-cell battery pack.

Power converter 24 is implemented in FIG. 1 as a boost converter, which uses inductor 30, transistors 32 and 34, and capacitor 36 to produce a voltage across capacitor 36 that exceeds the voltage of battery 22. Transistors 32 and 34 are driven by signals output by controller 28.

Controller 28 includes pulse width modulator (PWM) 38, which is controlled by feedback circuit 40. Feedback circuit 40 receives LED current feedback voltage 42, which is a signal that represents the amount of current flowing through LED 26. Feedback voltage 42 is taken from current sense resistor 44. Feedback circuit 40 compares LED current feedback voltage 42 to a reference voltage 46 in order to generate an error signal 48 that is coupled to PWM 38.

According to an important aspect of the present invention, battery voltage signal 50 is also input into feedback circuit 40 so that the current through LED 26 may be adjusted in proportion to, or as a function of, the battery voltage.

The output of PWM 38 is connected to transistor 32, and through inverter 52 an inverted PWM output is connected to transistor 34. In operation, transistors 32 and 34 are alternately switched to a conducting state. When transistor 32 is turned on, energy is stored in inductor 30. After a period of time, transistor 32 is turned off and transistor 34 is turned on, which transfers the energy stored in inductor 30 to capacitor 36. The period of time that transistor 32 is turned on determines the amount of energy, and the voltage, that is transferred to capacitor 36. Therefore, the ratio of the "on time" of transistor 32 to the "on time" of transistor 34 determines the output voltage of power converter 24. The output of PWM 38 is a square wave having a duty cycle that sets this ratio of on times, and thus controls the output voltage of power converter 24.

The duty cycle of the output of PWM 38 is controlled by control signal 48, which is output by feedback circuit 40. Feedback circuit 40 generates control signal 48 as a function of voltage reference $V_{ref}$ 46 compared to LED current feedback voltage 42, adjusted or offset as a function of battery voltage signal 50. Note that LED current feedback voltage 42 may be an output from operational amplifier (op amp) 54, which amplifies the voltage across current sense resistor 44. The amplification of the op amp 54 allows the use of a lower resistance in current sense resistor 44 to reduce power loss in the sense resister.

To extend the battery life of a single charge of battery 22, the present invention offsets control signal 48 in response to battery voltage signal 50, which in a preferred embodiment is the power supply voltage. This offsetting reduces the regulated current through LED 26 as battery voltage signal 50 falls, indicating the end of the life of the charge on the battery 22. By reducing the current through the LEDs, the battery charge may be extended so that the function of the device may be performed for an extended time with reduced LED brightness.

Figure 2:
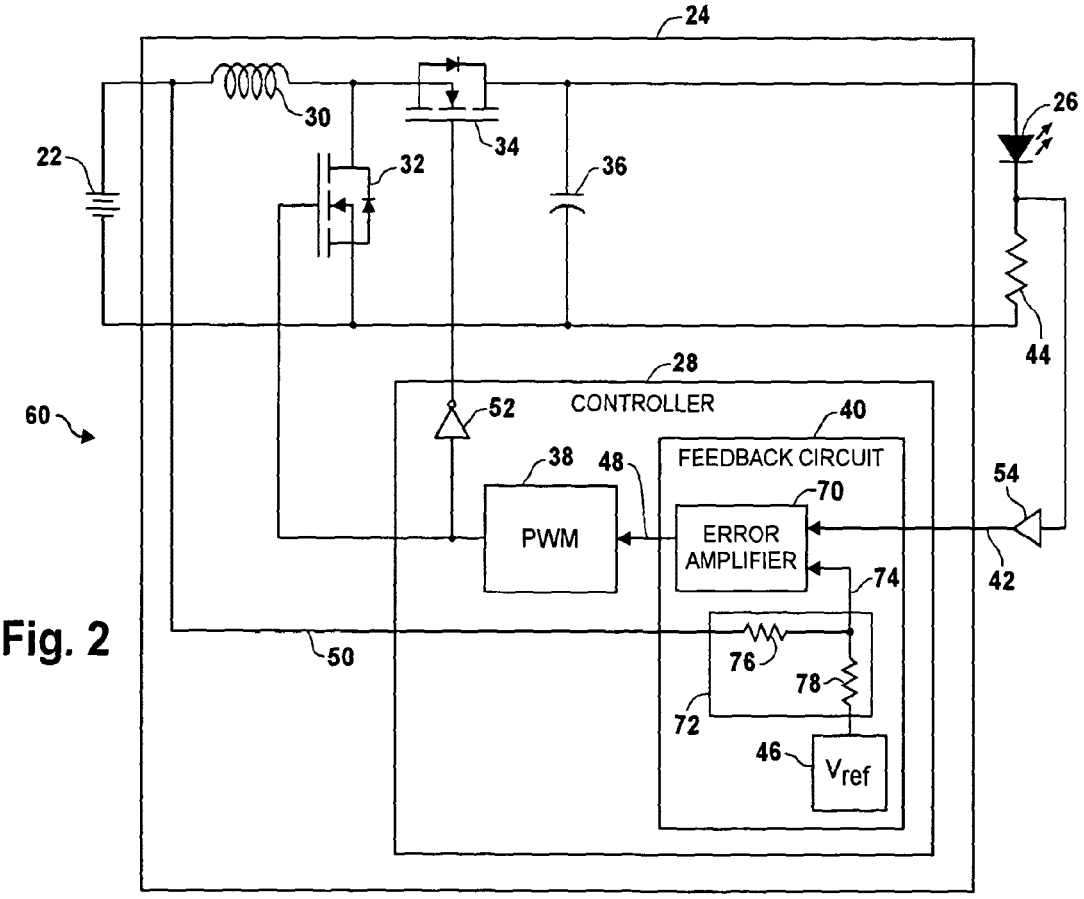
FIG. 2 is a more detailed schematic diagram of a first embodiment of a drive circuit for driving an LED in accordance with the method and apparatus of the present invention.
Figure 3:
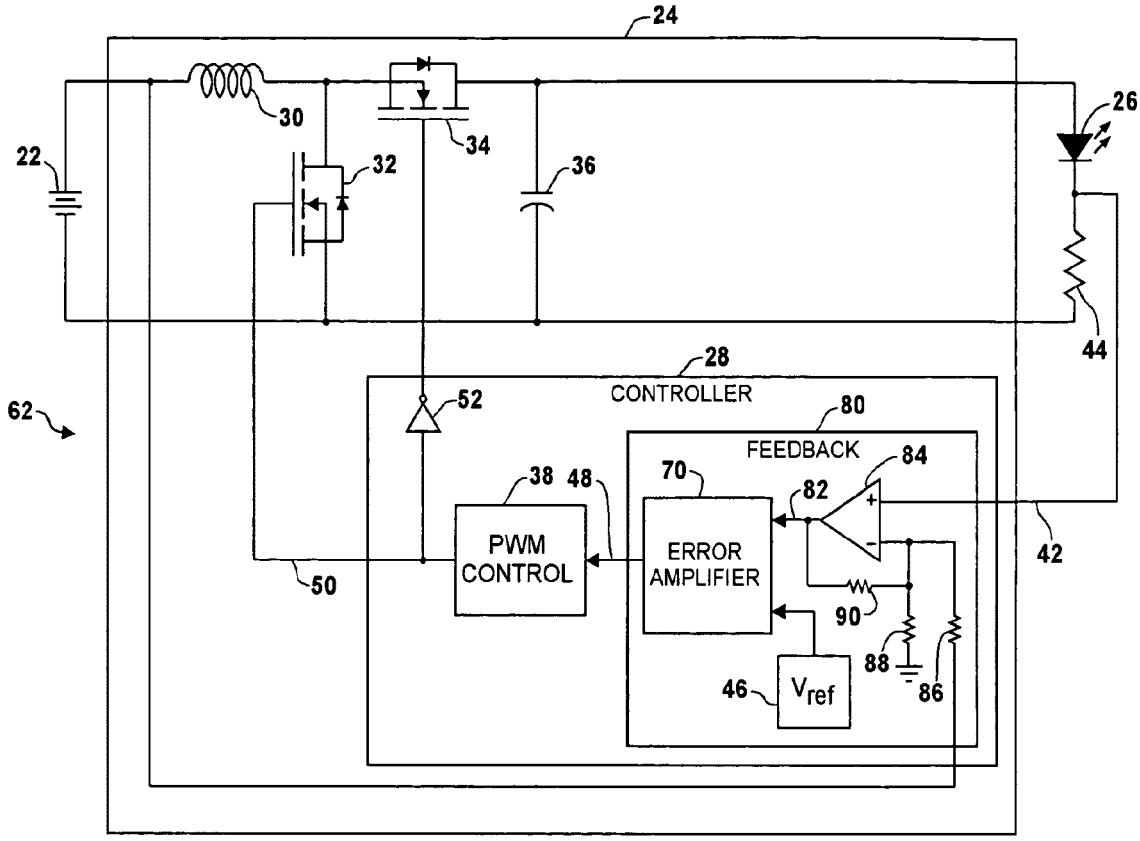
FIG. 3 is a schematic diagram of a second embodiment of a drive circuit for driving an LED in accordance with the method and circuit of the present invention.

Referring now to FIGS. 2 and 3, there are depicted two methods of offsetting or changing control signal 48 in response to the power supply voltage. In the first embodiment, which is implemented as LED drive circuit 60 in FIG. 2, reference voltage 46 is offset, which in turn offsets control signal 48. This embodiment changes the reference voltage in proportion to the power supply voltage. In the second embodiment, which is implemented as LED drive circuit 62 shown in FIG. 3, offsetting the control signal is implemented by changing a feedback voltage that represents the sensed current through LED 26 in proportion to the power supply voltage.

The differences between the general LED drive circuit 20 of FIG. 1 and the first embodiment—LED drive circuit 60 shown in FIG. 2—occur in feedback circuit 40 in controller 28. As illustrated, feedback circuit 40 includes error amplifier 70, which produces control signal 48. LED current feedback voltage 42 provides one input into error amplifier 70. The other input is a combination of reference voltage 46 and battery voltage signal 50. The combined voltage is produced by a voltage combining circuit, such as resistor network 72. The output of resistor network 72 may be referred to as combined reference voltage 74. Resistor network 72 includes resistors 76 and 78. Combined reference voltage 74 may be calculated according to the following formula:

$$V_{COMB} = \frac{R_{76}}{R_{76}+R_{78}} * V_{REF} + \frac{R_{78}}{R_{76}+R_{78}} * V_{BAT} \quad \text{Eq. 1}$$

According to Eq. 1, when $V_{bat}$ decreases, $V_{comb}$ decreases as well. A decrease in $V_{comb}$ 74 causes a proportional decrease in control signal 48, thereby reducing the set point of the regulated current through LED 26.

If the gain of op amp 54 is K (K≧1) and the LED current is $I_{LED}$, then the current through LED 26 $I_{LED}$ may be calculated as shown below:

$$K * I_{LED} * R_{SENSE} = V_{COMB} \quad \text{Eq. 2}$$

$$I_{LED} = \frac{\frac{R_{76}}{R_{76}+R_{78}} * V_{REF} + \frac{R_{78}}{R_{76}+R_{78}} * V_{BAT}}{K * R_{SENSE}} \quad \text{Eq. 3}$$

As may be seen from Eq. 3 above, when battery voltage signal $V_{BAT}$ 50 drops, the current through LED 26, $I_{LED}$, also drops. The ratio of the value of resistor 76 to resistor 78 determines the impact of a drop in battery voltage signal 50 on the regulated value of $I_{LED}$.

With reference now to FIG. 3, there is depicted a second embodiment of the general LED drive circuit 20 shown in FIG. 1. In this embodiment, LED drive circuit 62 includes feedback circuit 80, wherein the sensed LED current is changed in proportion to the power supply voltage. As illustrated, error amplifier 70 produces control signal 48, which is used to control pulse with modulator 38. One input to error amplifier 70 is $V_{REF}$ from reference voltage 46. The other input to error amplifier 70 is combined feedback voltage 82, which is a combination of LED current feedback voltage 42 and battery voltage signal 50.

To produce combined feedback voltage 82, op amp 84 receives LED current feedback voltage 42 in a non-inverting input. A portion of battery voltage signal 50 is input into the inverting input of op amp 84. Resistors 86 through 90 set the gain of op amp 84 and its sensitivity to changes in battery voltage signal 50. The derivation of the current through LED 26 is shown by the equations below:

$$V_{REF} = I_{LED} * R_{SENSE} * \left(1 + \frac{R_{90}}{R_{88} // R_{86}}\right) - \frac{R_{90}}{R_{86}} * V_{BAT} \quad \text{Eq. 4}$$

$$\text{If } R_{86} \gg R_{88}, \text{ then } R_{88} // R_{86} \cong R_{88} \quad \text{Eq. 5}$$

$$V_{REF} = I_{LED} * R_{SENSE} * \left(1 + \frac{R_{90}}{R_{88}}\right) - \frac{R_{90}}{R_{86}} * V_{BAT} \quad \text{Eq. 6}$$

-continued $$I_{LED} = \frac{V_{REF} + \frac{R_{90}}{R_{86}} * V_{BAT}}{R_{SENSE} * \left(1 + \frac{R_{90}}{R_{88}}\right)} \quad \text{Eq. 7}$$

In this example, a circuit for combining the LED current feedback voltage with the power voltage comprises a subtractor circuit having an op amp having an inverting input, a non-inverting input, and an output. As described, the inverting input is connected to the power supply voltage, $V_{BAT}$, through a resistor R1, and connected to a ground through a resistor R2, and connected to the output through a resistor R3. The non-inverting input is connected to the LED current feedback voltage, $V_{FB}$, and wherein the combined feedback voltage, $V_{CFB}$, is substantially equal to $$V_{CFB} = V_{FB} * \left(1 + \frac{R3}{R2}\right) - \frac{R3}{R1} * V_{BAT}.$$

From the above description, it can be seen that a subtractor circuit for subtracting a portion of the power supply voltage from the LED current feedback voltage is provided.

From Eq. 7 above, it should be apparent that when battery voltage signal $V_{BAT}$ 50 drops, the current $I_{LED}$ through LED 26 will also drop.

Figure 4:
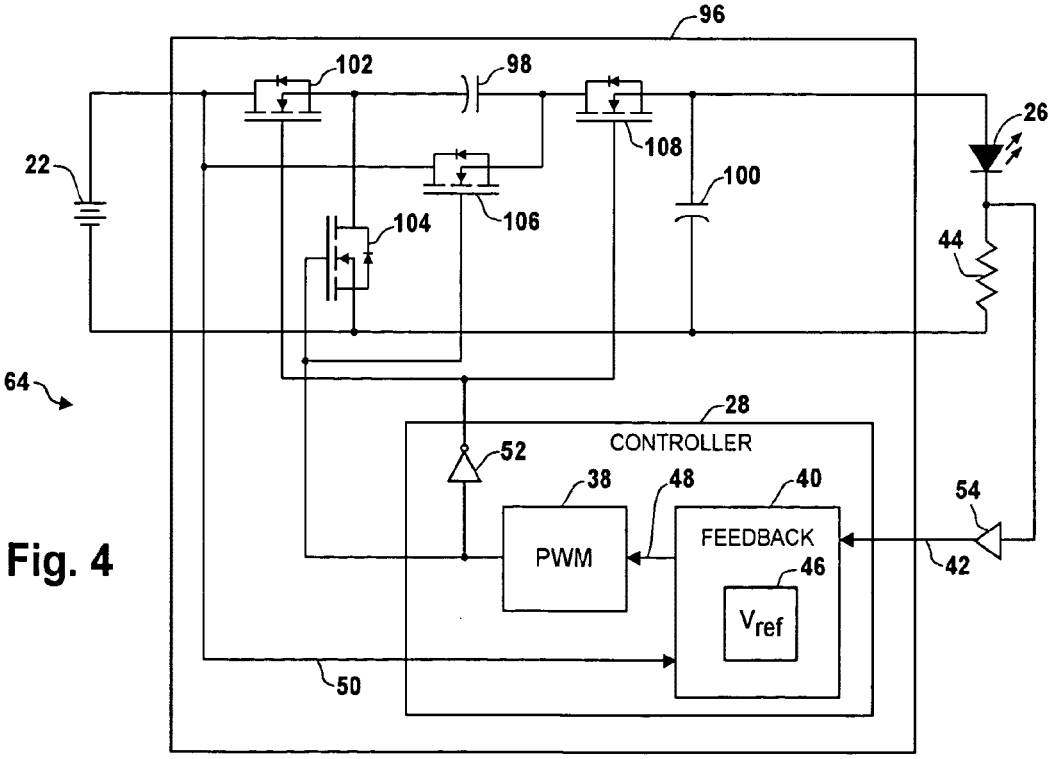
FIG. 4 is a high-level schematic diagram of a drive circuit using a charge pump power converter for driving an LED in accordance with the method and circuit of the present invention.

Referring now to FIG. 4, there is depicted a high-level schematic diagram of LED drive circuit 64 that uses a charge pump power converter for driving an LED in accordance with the method and circuit of the present invention. LED drive circuit 64 of FIG. 4 is similar to LED drive circuit 20 shown in FIG. 1 except that the power converter of FIG. 4 uses a charge pump instead of a boost converter, which is used in FIG. 1. Therefore, power converter 96 is a charge pump that uses capacitors 98 and 100 for charging and transferring charge to produce an output voltage greater than the voltage of battery 22. Capacitors 98 and 100 operate in conjunction with transistors 102 through 108, which are connected in a typical charge pump configuration. Transistors 104 and 108 are connected and controlled by the non-inverted output of PWM 38. Transistors 104 and 106 are connected and controlled by the output of inverter 52, which is an inverted output of PWM 38.

In a first phase of operation, transistors 106 and 104 are turned on and transistors 102 and 108 are turned off, in order to charge capacitor 98. Then, in a second phase of operation, transistors 102 and 108 are turned on and transistors 106 and 104 are turned off in order to transfer the charge from capacitor 98 and battery 22 to capacitor 100. Thus, in the second phase, the voltage of the charge in capacitor 98 is added to the voltage of battery 22. The length of time of charging capacitor 98 is proportional to, and determines the output voltage of, power converter 96.

Note that feedback circuit 28 may be implemented by either the embodiment shown in FIG. 2 or the embodiment shown in FIG. 3. Therefore, the embodiment shown in FIG. 4 illustrates that different power converters can be used and controlled as a function of battery voltage in accordance with the method and circuit of the present invention.

Figure 5:
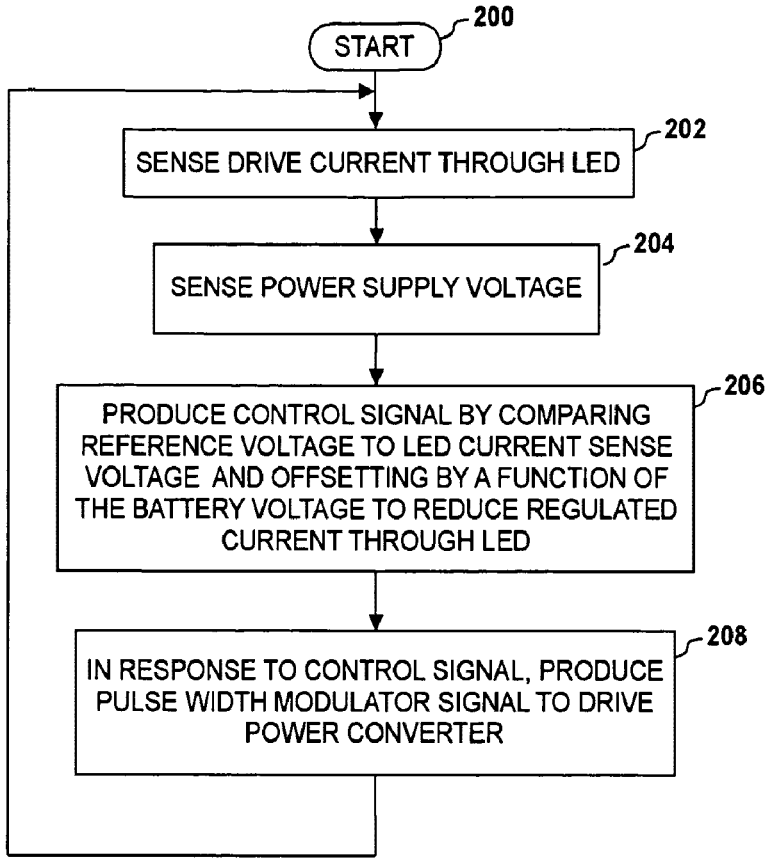
FIG. 5 is a high-level logic flowchart that illustrates the operation of the method and circuit of the present invention.

With reference now to FIG. 5, there is depicted a high-level logic flow chart that illustrates the operation of the method and circuit of the present invention. As illustrated, the process begin at block 200 and thereafter passes to block 202 wherein the process senses the drive current through the LED. Sensing the current through the LED is typically done by sensing a voltage across a current sense resistor, such as current sense resistor 44 shown in FIG. 1. Since power is dissipated in the sense resistor, and the voltage across the sense resistor further increases the drive voltage needed to drive the LED, the resistance of the sense resistor is preferably a low resistance. However, an LED current feedback voltage may need to have a higher voltage, which means that an op amp, such as op amp 54 in FIG. 1, may be used to amplify the voltage signal from the sense resistor.

Next, the process senses the power supply voltage, as illustrated at block 204. This step may be implemented by a conductor connected to the positive terminal of battery 22 to sense a voltage and provide it as an input to feedback circuit 40, as shown in FIG. 1.

After the sensing the current through the LED and sensing the power supply voltage, the process produces a control signal by comparing a reference voltage to the LED current sense voltage, and offsetting the comparison as a function of the power supply voltage to reduce the regulated current through the LED, as depicted at block 206. This process of generating the control signal may be implemented by either method depicted in FIG. 2 or in FIG. 3. The method illustrated in FIG. 2 produces a combined voltage reference by combining a fixed voltage reference with a portion of the power supply voltage to produce a combined reference voltage signal 74, which is input into error amplifier 70. Alternatively, the circuit in FIG. 3 combines a portion of the battery supply voltage with LED current feedback voltage 42 to produce a combined feedback voltage 82, which is then input into error amplifier 70 wherein it is compared to voltage reference 46.

After producing control signal 48, the process produces a pulse width modulator signal in response to control signal 48, as illustrated at block 208. Control signal 48 is shown in FIGS. 1-4 connected to a control input of PWM 38. The output of PWM 38 controls switching within power converter 24. The switching, and more specifically, the duty cycle of the switching, determines the output voltage of power converter 24, and hence the current, $I_{LED}$, through LED 26.

As indicated by the arrow from block 208 back to block 202, the process iteratively repeats in order to provide continuous feedback control of the LED drive circuit.

It should be apparent from the description above that the present invention regulates an LED drive current as a function of power supply or battery voltage in order to extend battery life as battery voltage falls at the end of the battery's charge. The invention has the advantage of providing extended use of a battery powered device by sacrificing some esthetic functionality in the form display or LED brightness. A power converter according to the present invention senses the battery voltage and changes a set point of a regulated output voltage or output current based on a reduction in battery voltage. Control signals that drive a pulse width modulator may be changed by changing one of the inputs to an error amplifier by combining such an input voltage with a voltage representing the power supply voltage.

Figure 6:
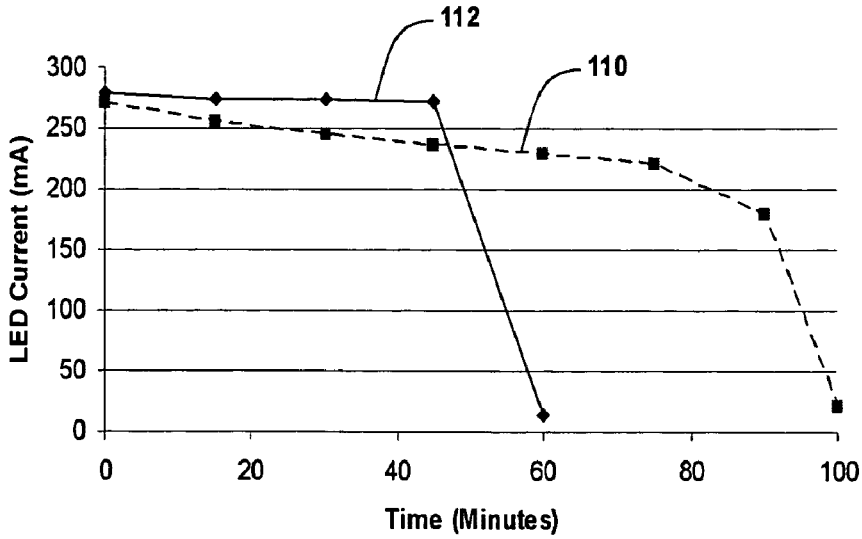
FIG. 6 is a graph of LED drive current in mA versus device operating time in minutes, which shows test results of extending battery life as regulated LED current is reduced as a function of battery voltage.

FIG. 6 is a graph of LED drive current, in mA, versus device operating time on a single battery charge, in minutes. As show in FIG. 6, the operation of a battery powered device may be extended by many minutes if the LED current is allowed to gradually decrease during battery-powered operation, as shown in graph 110. Battery-powered operation that attempts to maintain a fixed current through an LED over the life of a battery charge will quit operating much sooner, as shown in graph 112.

The foregoing description of a preferred embodiment of the invention has been presented for the purpose of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A feedback circuit in an integrated circuit comprising:

an error amplifier for comparing an LED current feedback voltage and a reference voltage to produce an LED current control signal, wherein the LED current control signal corresponds to a desired current flow in the LED, and wherein the output of the error amplifier controls a pulse width modulator in a power converter; and a circuit coupled to the error amplifier for changing the LED current control signal in response to a power supply voltage, wherein the circuit coupled to the error amplifier is a circuit for combining the reference voltage with the power supply voltage to produce a combined reference voltage that is directly proportional to the power supply voltage and wherein the circuit for combining the reference voltage with the power supply voltage to produce a combined reference voltage varies directly with the power supply voltage comprises a resistor divider network.

2. The feedback circuit according to claim 1 wherein the resistor divider network comprises R1 and R2 connected in series, and wherein the power supply voltage is a battery voltage, $V_{BAT}$, and $V_{BAT}$ is connected to R1, and the reference voltage, $V_{REF}$, is connected to R2, and wherein the combined reference voltage, $V_{CREF}$, at a connection between R1 and R2 is substantially equal to $$V_{CREF} = \frac{R1}{R1 + R2} * V_{REF} + \frac{R2}{R1 + R2} * V_{BAT}$$

which varies directly with the power supply voltage.1

3. A feedback circuit in an integrated circuit comprising:

an error amplifier for comparing an LED current feedback voltage and a reference voltage to produce an LED current control signal, wherein the LED current control signal corresponds to a desired current flow in the LED, and wherein the output of the error amplifier controls a pulse width modulator in a power converter; and a circuit coupled to the error amplifier for changing the LED current control signal in response to a power supply voltage, wherein the circuit coupled to the error amplifier is a circuit for combining the LED current feedback voltage with the power supply voltage to produce a combined feedback voltage that is directly proportional to the power supply voltage and wherein the circuit for combining the LED current feedback voltage with the power supply voltage comprises a subtractor circuit for subtracting a portion of the power supply voltage from the LED current feedback voltage.

4. The feedback circuit according to claim 3 wherein the subtractor circuit comprises an op amp having an inverting input, a non-inverting input, and an output, and wherein the inverting input is connected to the power supply voltage, $V_{BAT}$, through a resistor R1, and connected to a ground through a resistor R2, and connected to the output through a resistor R3, and wherein the non-inverting input is connected to the LED current feedback voltage, $V_{FB}$, and wherein the combined feedback voltage, $V_{cFB}$, is substantially equal to $$V_{CFB} = V_{FB} * \left(1 + \frac{R3}{R2}\right) - \frac{R3}{R1} * V_{BAT}.$$

5. A feedback circuit in an integrated circuit comprising:

an error amplifier for comparing an LED current feedback voltage and a reference voltage to produce an LED current control signal, wherein the LED current control signal corresponds to a desired current flow in the LED, and wherein the output of the error amplifier controls a pulse width modulator in a power converter; and a circuit coupled to the error amplifier for changing the LED current control signal in response to a power supply voltage, wherein the circuit coupled to the error amplifier is a circuit for combining the reference voltage with the power supply voltage to produce a combined reference voltage that is offset in proportion to the power supply voltage and wherein the circuit for combining the reference voltage with the power supply voltage to produce a combined reference voltage comprises a resistor divider network.

6. The feedback circuit according to claim 5 wherein the resistor divider network comprises R1 and R2 connected in series, and wherein the power supply voltage is a battery voltage, $V_{BAT}$, and $V_{BAT}$ is connected to R1, and the reference voltage, $V_{REF}$, is connected to R2, and wherein the combined reference voltage, $_{VCREF}$, at a connection between R1 and R2 is substantially equal to $$V_{CREF} = \frac{R1}{R1 + R2} * V_{REF} + \frac{R2}{R1 + R2} * V_{BAT}$$

which varies with the power supply voltage.

7. A feedback circuit in an integrated circuit comprising:

an error amplifier for comparing an LED current feedback voltage and a reference voltage to produce an LED current control signal, wherein the LED current control signal corresponds to a desired current flow in the LED, and wherein the output of the error amplifier controls a pulse width modulator in a power converter; and a circuit coupled to the error amplifier for changing the LED current control signal in response to a power supply voltage, wherein the circuit coupled to the error amplifier is a circuit for combining the LED current feedback voltage with the power supply voltage to produce a combined feedback voltage that is offset in proportion to the power supply voltage and wherein the circuit for combining the LED current feedback voltage with the power supply voltage comprises a subtractor circuit for subtracting a portion of the power supply voltage from the LED current feedback voltage.

8. The feedback circuit according to claim 7 wherein the subtractor circuit comprises an op amp having an inverting input, a non-inverting input, and an output, and wherein the inverting input is connected to the power supply voltage, $V_{BAT}$, through a resistor R1, and connected to a ground through a resistor R2, and connected to the output through a resistor R3, and wherein the non-inverting input is connected to the LED current feedback voltage, $V_{FB}$, and wherein the combined feedback voltage, $V_{CFB}$, is substantially equal to $$V_{CFB} = V_{FB} * \left(1 + \frac{R3}{R2}\right) - \frac{R3}{R1} * V_{BAT}.$$

* * * * *

UNITED STATES PATENT AND TRADEMARK OFFICE

CERTIFICATE OF CORRECTION

PATENT NO. : 8,324,825 B2
APPLICATION NO. : 12/189411
DATED : December 4, 2012
INVENTOR(S) : Jianwen Shao et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 620 days.

Signed and Sealed this
Fourteenth Day of October, 2014

Michelle K. Lee

Michelle K. Lee
*Deputy Director of the United States Patent and Trademark Office*